US007444982B2

(12) United States Patent
Rivet

(10) Patent No.: US 7,444,982 B2
(45) Date of Patent: Nov. 4, 2008

(54) ENGINE AIR INTAKE SHUT OFF VALVE

(76) Inventor: Darren Rivet, 14215 - 120 Street, Edmonton, Alberta (CA) T5L 2R8

( * ) Notice: Subject to any disclaimer, the term of this patent is extended or adjusted under 35 U.S.C. 154(b) by 0 days.

(21) Appl. No.: 11/673,443

(22) Filed: Feb. 9, 2007

(65) Prior Publication Data

US 2007/0186901 A1 Aug. 16, 2007

Related U.S. Application Data

(60) Provisional application No. 60/772,191, filed on Feb. 9, 2006.

(51) Int. Cl.
*F02D 17/00* (2006.01)
*F02D 9/08* (2006.01)

(52) U.S. Cl. ..... 123/337; 123/397; 123/399; 123/400; 123/198 D

(58) Field of Classification Search ..... 123/337, 123/198 D, 339, 403, 397, 399, 361; 251/305
See application file for complete search history.

(56) References Cited

U.S. PATENT DOCUMENTS 4,381,100 A * 4/1983 Schoenberg ..... 251/368
4,501,238 A * 2/1985 Odum ..... 123/198 D
4,537,386 A * 8/1985 Krepela et al. ..... 251/302
4,546,954 A * 10/1985 Bodnar ..... 251/88
5,003,943 A 4/1991 Lafferty
5,050,548 A 9/1991 Minegishi
5,203,536 A 4/1993 Krepela
5,205,252 A 4/1993 Krepela
5,653,207 A * 8/1997 Denton ..... 123/198 D
5,873,343 A 2/1999 Denton
6,032,921 A * 3/2000 Krepela ..... 251/63.4
6,273,053 B1 * 8/2001 Krepela et al. ..... 123/198 D
6,276,328 B1 8/2001 Denton et al.
6,478,011 B2 * 11/2002 Paffrath ..... 123/336
6,584,381 B2 6/2003 Gehrke
6,647,328 B2 11/2003 Walker
6,802,295 B2 * 10/2004 Bedwell et al. ..... 123/198 D
6,827,060 B2 * 12/2004 Huh ..... 123/336
6,837,474 B1 1/2005 DeJonge
6,873,246 B1 3/2005 Ligoci et al.
6,920,864 B1 * 7/2005 Roche et al. ..... 123/337

(Continued)

FOREIGN PATENT DOCUMENTS

CA 2299929 3/2004

(Continued)

OTHER PUBLICATIONS www.amot.com, Hydromechanical Engine Shutdown System, 2004, United States.

(Continued)

*Primary Examiner*—Hai H Huynh
(74) *Attorney, Agent, or Firm*—Bennett Jones LLP

(57) ABSTRACT

The invention is directed to a shut-off valve for stopping the air-flow to an engine. A butterfly valve disposed in an air passage is moved between a first open position and second closed position in a controlled fashion to prevent the build up un-burnt fuel in the event of the activation of the valve.

27 Claims, 9 Drawing Sheets

U.S. PATENT DOCUMENTS

| | | | |
|---|---|---|---|
| 7,049,709 | B2 | 5/2006 | Boggs |
| 2003/0056754 | A1 | 3/2003 | Prysko |
| 2004/0226436 | A1 | 11/2004 | Orr |
| 2005/0066938 | A1 | 3/2005 | Iannone et al. |

FOREIGN PATENT DOCUMENTS

| | | | |
|---|---|---|---|
| EP | 1000826 | | 5/2000 |
| GB | 2298301 | | 8/1996 |
| JP | 64-41623 | * | 2/1989 |
| JP | 2006-200463 | * | 8/2006 |
| WO | 9943513 | | 9/1999 |

OTHER PUBLICATIONS www.nationstrack.com, Simplifying GPS Technology, United States.

* cited by examiner

ENGINE AIR INTAKE SHUT OFF VALVE

CROSS REFERENCE TO RELATED APPLICATIONS

This application claims priority benefit of U.S. Provisional Application No. 60/772,191 filed on Feb. 9, 2006 entitled "Engine Shut-Off Valve", the contents of which are incorporated herein by reference.

FIELD OF THE INVENTION

The present invention relates to an engine shut-off valve, and in particular to an air intake shut-off valve for a diesel engine.

BACKGROUND

Engines, in particular diesel engines, can enter an uncontrolled state known as 'run away'. In this state the engine experiences unrestrained combustion and if not stopped, the engine can reach destructive speeds that can result in catastrophic engine failure, and even personal injury to those in proximity. There are a number of causes of run away in engines including, without limitation, a faulty engine governor, engine overheating or the ingestion of unregulated hydrocarbons into the combustion chamber. Such hydrocarbons may be from an external source such as gaseous airborne forms, or from the engine itself due to a malfunction such as failure of turbo charger oil seals.

The conventional way to stop a diesel engine is to stop the flow of fuel to the combustion chamber. However, an alternate method must be employed to stop a diesel engine in the event of run away. The most common method used involves removing the air supply to the combustion chamber. Once deprived of oxygen, the uncontrolled combustion ceases. Accordingly, safety valves which cut off the air supply to the engine have been developed to shut off the engine in such a situation.

Typical shut-off valves are positioned in the air intake to the engine and employ a valve that is spring biased to be in a closed position that blocks air supply to the combustion chamber. The spring loaded valve is held in an open position by a solenoid or by other appropriate restraint means, thereby allowing an unobstructed air supply into the engine. Upon run away occurring, there is a de-activation of the restraint means, and the valve snaps into its closed position, thus cutting off the air supply to combustion chamber and starving the engine of air until it stalls. Other variations of cut-off valve systems employing various activation means have also been developed, but all commonly employ a system whereby a valve snaps shut upon receipt of some form of stimulus. The instantaneous removal of the air supply using such a conventional valve systems results in significant amount of un-burnt diesel fuel remaining in the engine. The pooled fuel can have a deleterious effect on engine components. Further, upon subsequent start-up of engine after shut down, the fuel loaded engine can experience smoking, engine noise, and even engine damage.

It is, therefore, desirable to provide a shut-off valve which mitigates these limitations.

SUMMARY OF THE INVENTION

The present invention is directed to a shut-off valve for the air intake of an engine. Accordingly, in one aspect of the invention, the invention comprises an air intake shut-off valve for an engine having an air intake, the shut-off valve comprising;

(a) a housing having an air-flow passage extending through the housing;

(b) a flow control valve disposed in the air-flow passage, the flow control valve being movable between a first open position that permits air-flow through the passage and a second closed position that prevents air-flow through the passage;

(c) actuation means for moving the flow control valve between its first open position and its second closed position, and for moving the flow control valve between its second closed position and its first open position;

(d) switch means for activating and deactivating the actuation means; and (e) means for sealably connecting the air-flow passage to the air intake of the engine;

whereby the flow control valve moves between its first open position and its second closed position in a predetermined period of time.

In one embodiment, the flow control valve is a butterfly valve. In another embodiment, the actuation means comprises an actuator having a drive means for controlling the movement of the flow control valve between its first open position and its second closed position and between its second closed position and its first open position. In one embodiment, the actuator comprises a pinion gear connected to the flow control valve, a worm gear driving the pinion gear, and an electric motor driving the worm gear.

In an embodiment, the actuation means is adapted to move the flow control valve between its first open position and its second closed position in a period of time that is greater than 1 second, but that is less than 6 seconds. In one embodiment, the period of time is about 2 seconds to about 3 seconds, and in another embodiment the period of time is about 4 seconds to about 5 seconds.

In one embodiment the switch means is responsive to an operating condition of the engine, the engine operating condition including any one of temperature, pressure or revolutions per minute ("RPM"). In one embodiment, the switch means is responsive to an operating condition of an ancillary component of the engine. In various embodiments the switch means is responsive to a manually transmitted signal, or to a remotely transmitted signal. In one embodiment the switch means comprises an electronic controller module, and in one embodiment the electronic controller module controls the speed of the electric motor.

In an embodiment, the electronic controller module may be pre-programmed to activate the actuation means upon the occurrence of a specific operating condition of the engine, the specific engine operating condition including any one of a specific temperature level, a specific pressure level or a specific RPM level. In one embodiment, the electronic controller module is responsive to an operating condition of an ancillary component of the engine In one embodiment there is a valve sensor connected to the electronic controller module to sense whether the flow control valve is open or shut. In one embodiment, the valve sensor comprises a micro-switch engaging the flow control valve mechanism, the micro-switch being electronically connected to the electronic controller module.

In another embodiment, the apparatus has a display means connected to the electronic controller module, the display having indicators. In one embodiment, the display means has indicators for indicating what caused the electronic controller module to activate the actuator means to close the flow control valve.

In one embodiment, the housing comprises a drive housing that is releasably attached to a tubular channel housing, the channel housing defining the air-flow passage. In another embodiment, the drive housing comprises a motor and gear housing sandwiched between a top cover and a base cover.

In one embodiment, the means for sealably connecting the air-flow passage to the air intake of the engine comprises at least one sleeve extending outwards from the air-flow passage. In another embodiment, the a standard size of shut off valve is adaptable for use in varying sizes of air intakes by using differing sizes of sleeves.

In another aspect of the present invention, the invention comprises an air intake shut-off valve for an engine having an air intake, the shut-off valve comprising;

(a) a housing having an air-flow passage extending through the housing;
(b) a butterfly valve disposed in the air-flow passage, the butterfly valve being movable between a first open position that permits air-flow through the passage and a second closed position that prevents air-flow through the passage, the butterfly valve having a central shaft;
(c) a pinion gear connected to the shaft of the butterfly valve;
(d) a worm gear driving the pinion gear;
(e) an electric motor connected to the worm gear;
(f) a controller module for activating and deactivating the electric motor and for controlling the speed of the motor; and
(g) means for sealably connecting the air-flow passage to the air intake of the engine;

whereby rotation of the worm gear causes rotation of the shaft of the butterfly valve such that the butterfly valve can be moved between its first open position and its second closed position and between its second closed position and its first open position in a pre-determined period of time.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Scope

The present invention provides for a shut-off valve for the air intake of an engine. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Description

Figure 1:
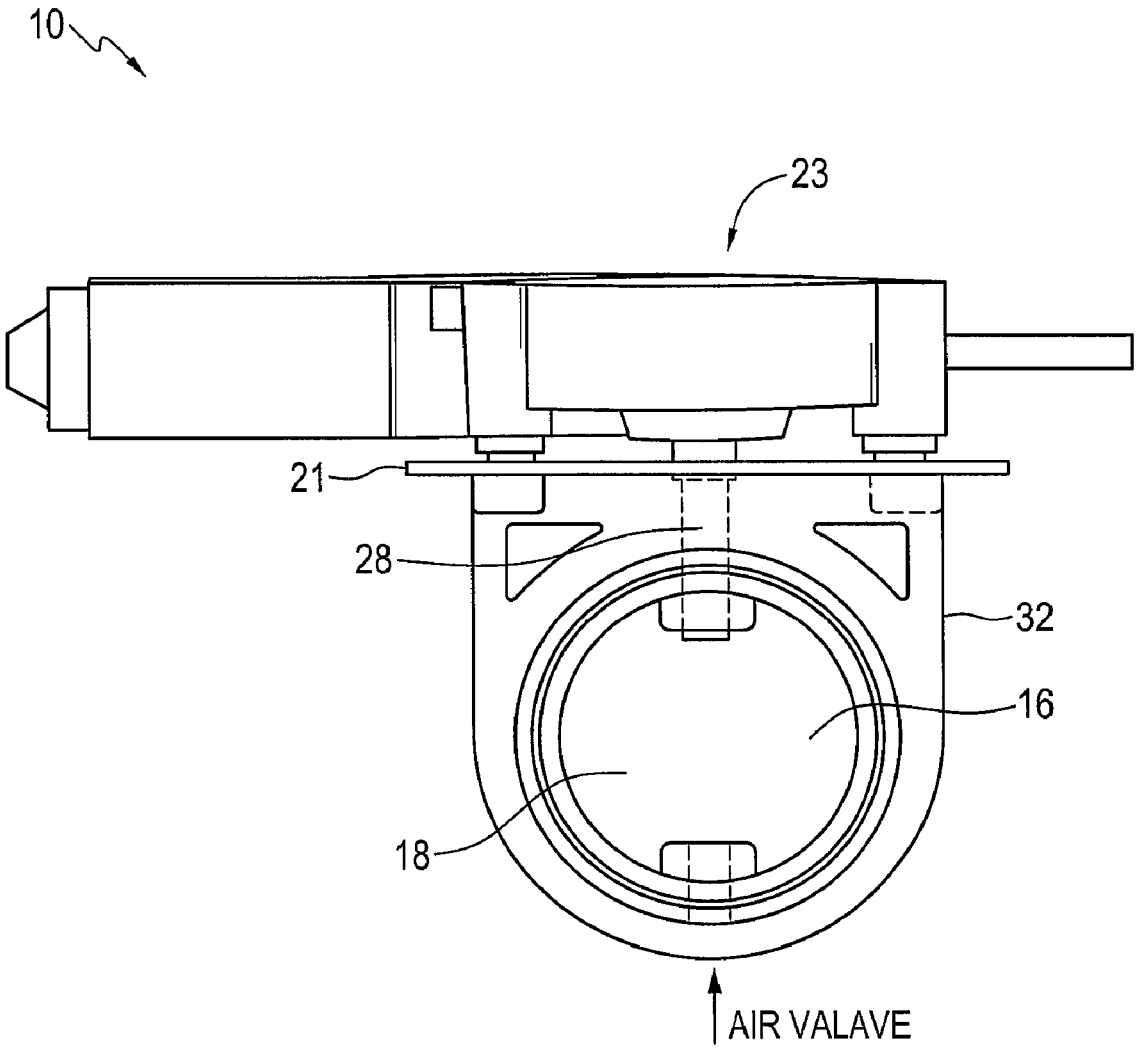
FIG. 1 is a diagrammatic front view of one embodiment of the present invention.
Figure 9A:
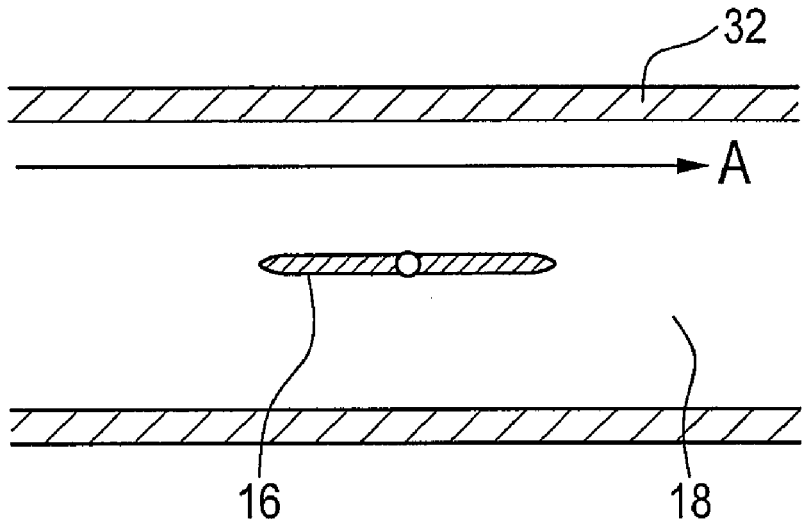
FIGS. 9A and 9B are sectional top views of a butterfly valve within the air-flow passage of one embodiment of the present invention.
Figure 9B:
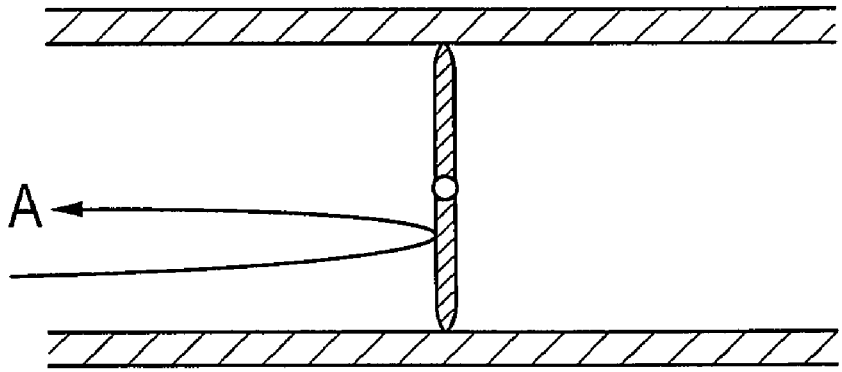

The present invention is directed to a shut-off valve for the air intake of an engine. As shown in FIG. 1, the shut-off valve (10) is comprised of a housing (20) defining an air-flow passage (18). Avow control valve is disposed in the air-flow passage (18) and is movable between a first open position that permits the flow of air through the air-flow passage (18), and a second closed position that prevents air flow through the air-flow passage (18). As shown in the Figures, in one embodiment, a butterfly valve (16) can be used. Although use of a butterfly valve will be described, it should be understood that other suitable flow control valves, such as a ball valve, may also be used to practice the present invention. As shown in FIGS. 9A and 9B, the butterfly valve is moveable between a first open position in which it is parallel to the flow of air (arrow A) through the air flow passage (18), and a second closed position in which it is perpendicular to the flow of air (arrow A) in the air flow passage (18). As seen in FIG. 9A, when the butterfly valve (16) is in its first open position, air flow through the air-flow passage is substantially unobstructed. However, as seen in FIG. 9B, when the butterfly valve (16) is moved into its second closed position, air flow is blocked.

Figure 2:
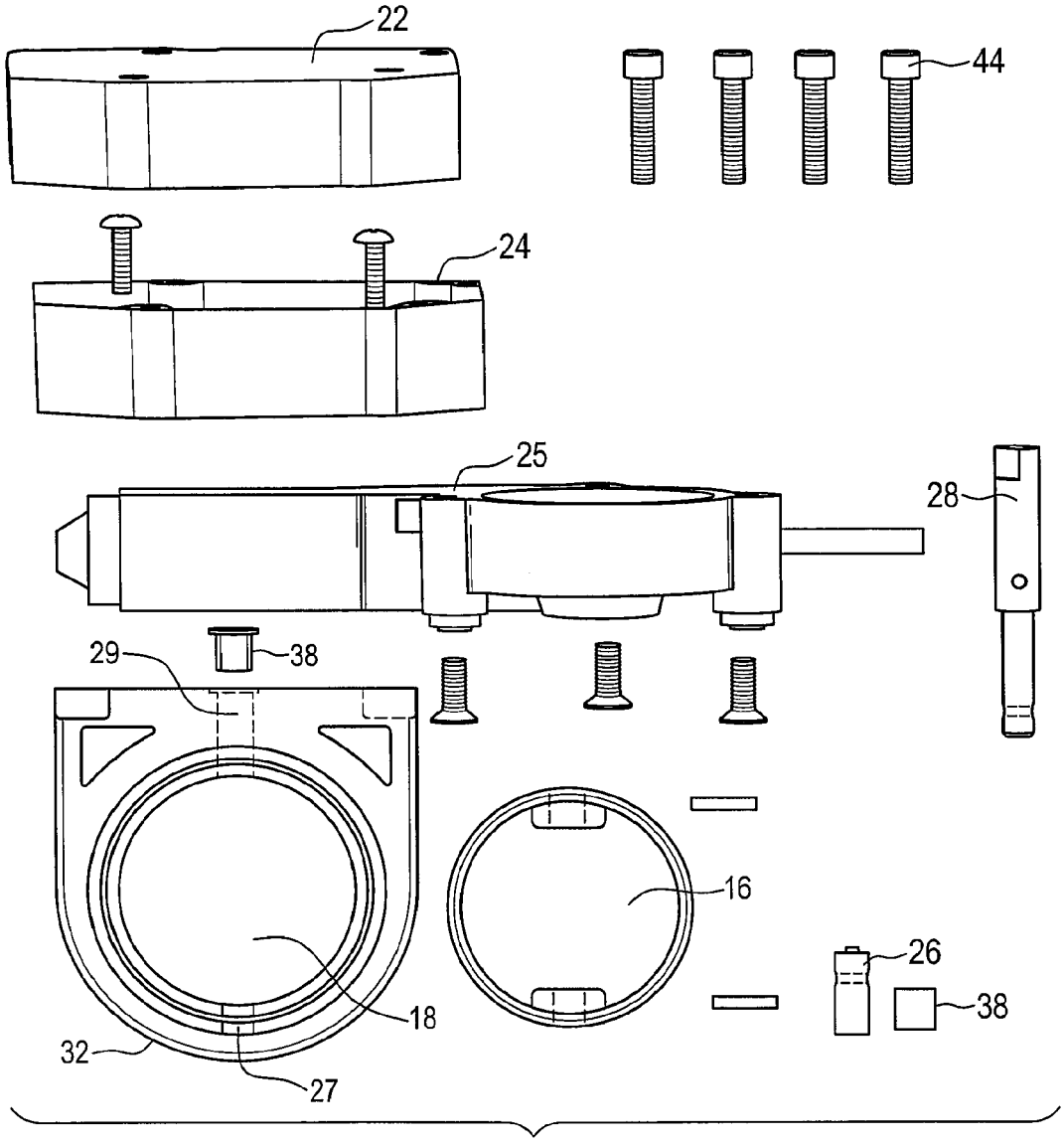
FIG. 2 is a diagrammatic exploded front view of the components of one embodiment of the present invention.
Figure 3:
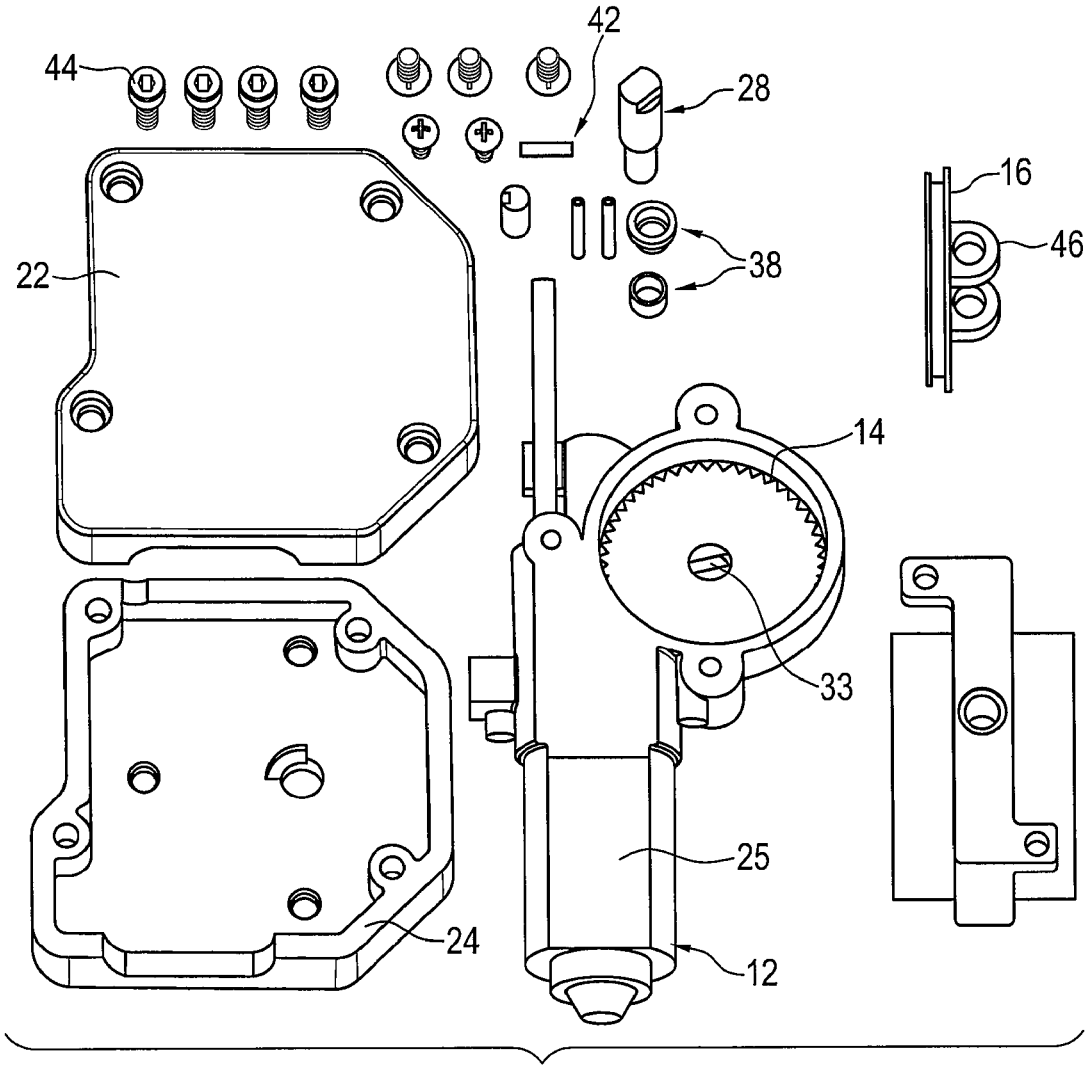
FIG. 3 is a diagrammatic view of the components of one embodiment of the present invention.
Figure 4:
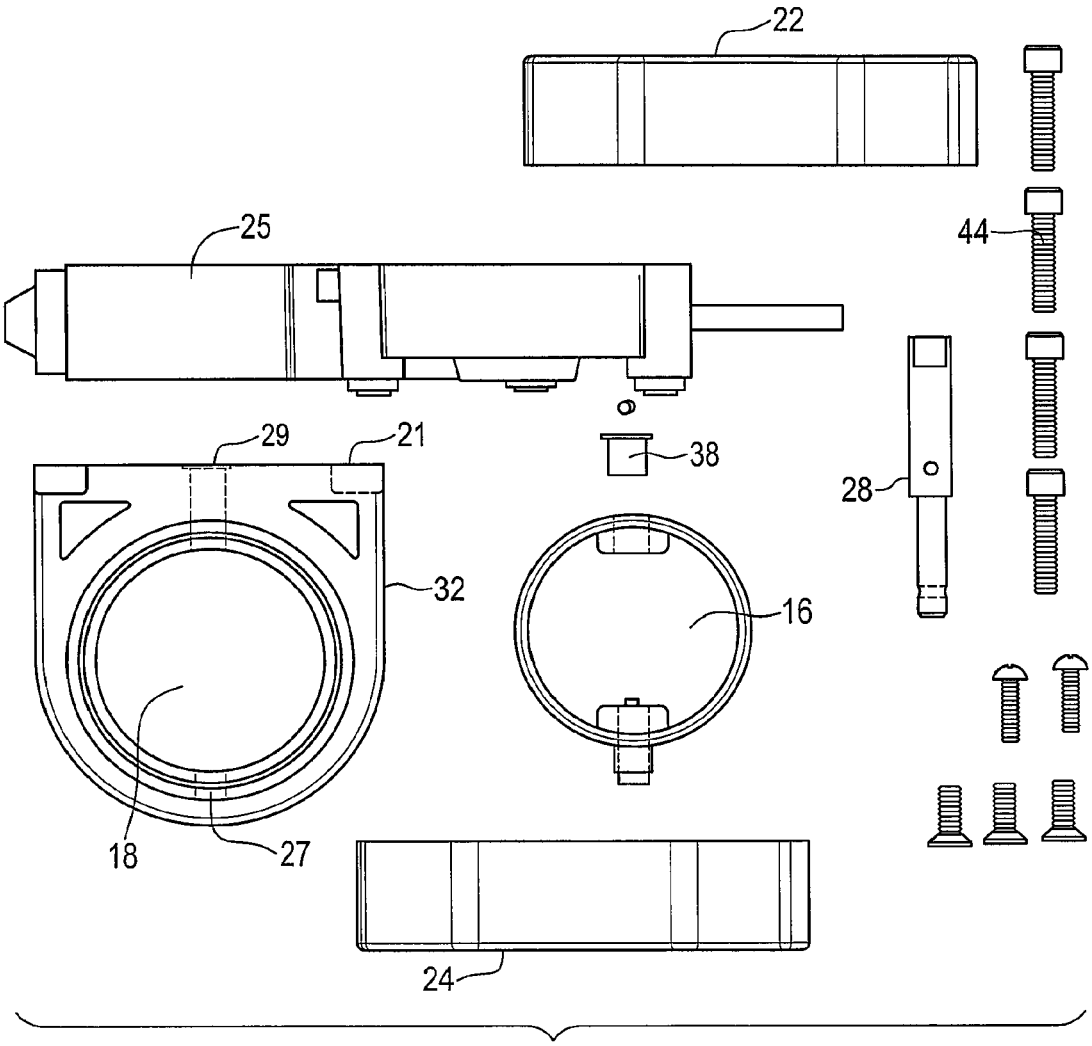
FIG. 4 is an exploded diagrammatic front view of the components of one embodiment of the present invention.
Figure 5:
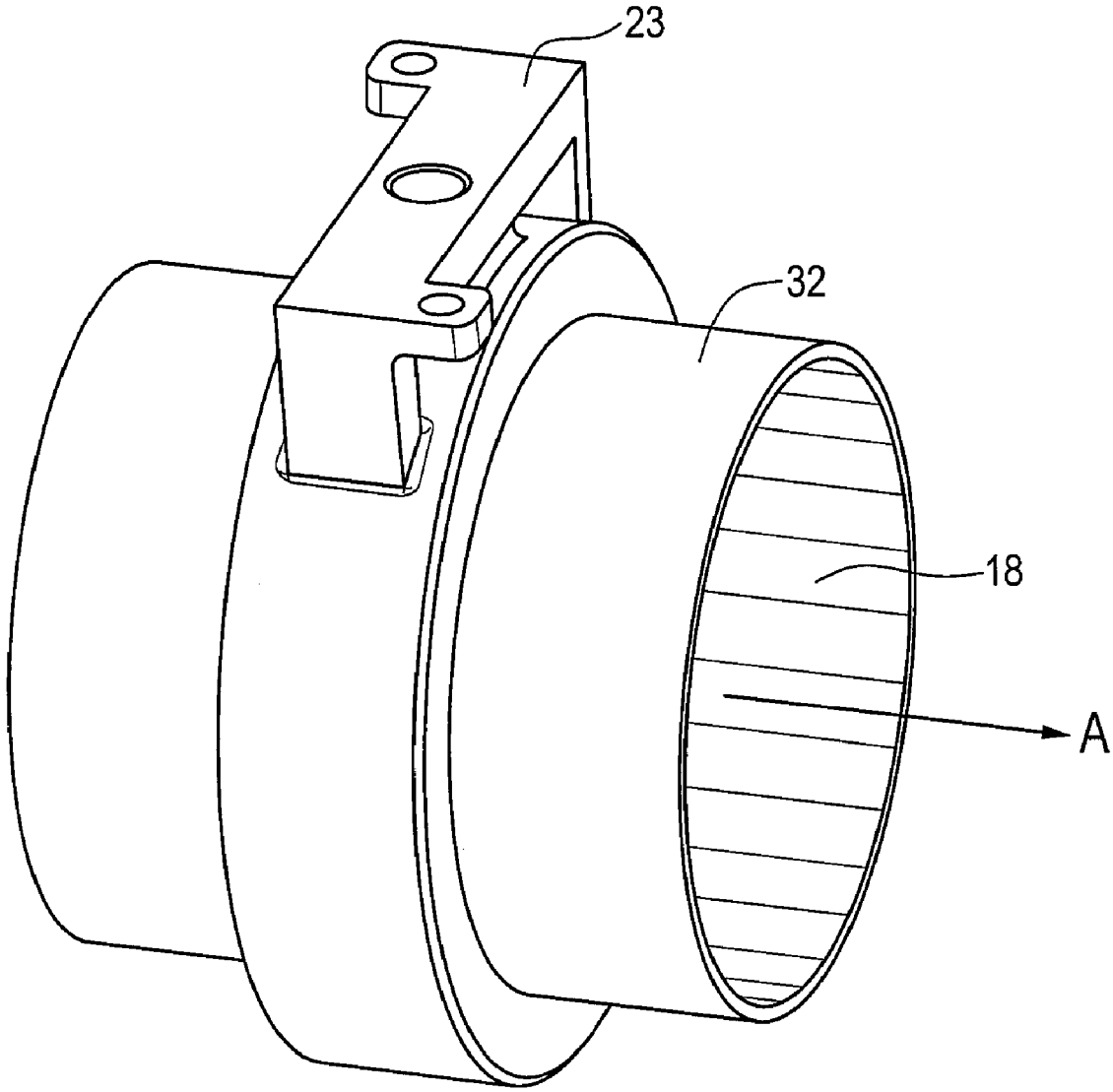
FIG. 5 is a diagrammatic depiction of one embodiment of the present invention.

As shown in FIGS. 1, 2 and 4, in one embodiment the housing (20) is comprised of a drive housing (23) attached to a tubular channel housing (32). The drive housing (23) contains the electric motor (12) and the worm gear (14). The worm gear (14) is driven by a worm shaft (not shown in the Figures) connected to the electric motor (12). In one embodiment, the drive housing (23) is further comprised of a motor and gear housing (25) that is sandwiched between a top cover (22) and a base cover (24). The tubular channel housing (32) defines the air flow passage (18). The channel housing (32) may have a plate (21) to facilitate the attachment of the base cover (24) of the drive housing (23). The housing components are releasably attached to each other using screws (44), or any other suitable attachment means as would be employed by one skilled in the art. The electric motor (12) is mounted in the motor and gear housing (25) using motor mount screws, or using any other suitable attachment mechanism.

As shown in FIGS. 1, 2, 4 and 7, the butterfly valve (16) is round shaped and corresponds in diameter size to the interior diameter of the air-flow passage (18). The butterfly valve has receptacles (46) on one side for a lower pin (26) and a shaft like pinion gear (28). Rotation of the pinion gear (28) causes corresponding rotation of the butterfly valve (16) about the longitudinal axis of the lower pin (26) and the pinion gear (28). The pinion gear (28) has associated upper and lower bushings (38) to facilitate rotation and has stopper pin (42) to hold the pinion gear in place. The tubular channel housing (32) has an opening (29) through which the pinion gear (28) may protrude into the air-flow passage (18), and it also has a complimentary recess (27) on its inner surface directly opposite the opening for the pinion gear for receiving the lower pin (26). Shut-off valve (10) has actuation means to drive the butterfly valve (16). In one embodiment the actuation means is an actuator having drive means for controlling the movement of the butterfly valve (16) between its first open position and its second closed position, and between its second closed position and its first open position.

As shown in FIGS. 1-7, the actuator may be comprised of the pinion gear (28) driven by a worm gear (14) that is driven by a worm shaft (not shown in the Figures) that is in turn driven-by the-electric motor (12). The worm gear (14) engages the pinion gear (28) of the butterfly valve (16) with a complimentary shaped opening (33). Thus, when the electric motor (12) is activated, the worm gear (14) is driven. The rotational movement of the driven worm gear (14) causes the pinion gear (28) to turn and this rotates the butterfly valve (16) within the air-flow passage (18). In this manner, the butterfly valve (16) is moved between its first open position and its second closed position. To move the butterfly valve (16) from its second closed position to its first open position after shut down, the polarity of the electric motor (12) is reversed by changing the charge of the current supply to the electric motor (positive to negative, and vice versa). This results in the electric motor (12) effectively running in reverse, causing the worm gear (14) to rotate in the opposite direction thus returning the butterfly valve (16) to its first open position. Any suitable type of electric motor that allows for reverse polarity, as commonly used for similar applications may be used with the present invention.

The shut-off valve (10) has a switch means for activating and deactivating the actuator, and in one embodiment this may be an electronic controller module (50).

It can be understood that by controlling the speed of the electric motor (12), the time it takes for the butterfly valve (16) to move from its first open position to its second closed position can be carefully controlled. In one embodiment, the electric motor (12) itself may be calibrated such that upon activation it will take a pre-determined period of time to move the butterfly valve (16) between desired positions, and such that it will de-activate upon the expiry of such time period. Thus, upon the activation electric motor (12) by the switch means, the electric motor (12) is turned on for a fixed period of time during which time the butterfly valve (16) moves between the open and closed position. Following shut down, the switch means is activated again and the process is repeated in reverse to return the butterfly valve (16) to its open position.

In another embodiment, the electronic controller module activates and deactivates the electric motor (12) and controls the electric motor (12) speed. The electronic controller module (50) may be programmed such that a user may pre-set the time period for butterfly valve closure based on the type of engine it is being used with.

The delayed or gradual closing of the butterfly valve (16) facilitates a tapered reduction of air to the combustion chamber. This has an effect similar to the quashing of a fire, and allows fuel present to be consumed and preventing the build up of un-burnt fuel in the engine. This mitigates the problems associated with the build up of un-burnt fuel in the engine. The appropriate period of time for closing the butterfly valve (16) is dependent on the size and type of the engine. The time taken by the butterfly valve (16) to close upon activation of the electric motor (12) can be adjusted and pre-set accordingly as discussed above. A time period of more than one second, but less than 6 seconds is suitable for most engines. For smaller valves, an appropriate time period may be between 2 to 3 seconds, and for larger valves a time period of between 4 to 5 seconds may be suitable.

Operation of the electric motor (12) may be initiated automatically in response to an engine operating condition such as heat, pressure or RPM. Upon the engine, or ancillary components to the engine, reaching a certain condition, sensors recognize the condition and a signal is transmitted to the switch means to activate the actuator, thereby closing the butterfly valve (16) and thus shutting down the engine. Input signals to the switch means to stimulate actuator movement may also may be manually transmitted signals such as someone pressing an emergency shut down button for example. Remotely transmitted signals may also be used to trigger the switch means such as a radio transmission for example. In one embodiment directed to vehicles, a transmitter may be used in a key fob type configuration to allow the shut down of the individual associated vehicle. It can be understood that the switch means on different engines may be configured to respond to different types of manual or remote signals. This facilitates the ability to have sequential or simultaneous shut down of engines within a fixed transmission radius using master signals. For example, switch means on certain engines may be adapted to receive signal type A, whereas switch means on certain other engines may be adapted to receive signal type B. Thus, using an oil rig as an example, in the event of an emergency situation such as a blow out, the safety supervisor could immediately transmit signal A, thereby activating all switch means adapted to receive signal A and thereby shutting down those associated engines. The engines with switch means adapted to receive signal B will represent those engines still needed in such an emergency situation such as back up generators, or fire pump engines. However, if those engines become compromised, the supervisor may then elect to transmit signal B, thereby shutting down all engines. It can be understood that vehicles equipped with the switch means adapted to receive remote signals, will also have their engines shut down if they enter the radius if the transmission signal in such emergency situations. Emergency vehicles such as fire-trucks and ambulances could be adapted to receive signal B, thereby allowing their continued operation in emergency circumstances if desired. The transmission of such remote signals may also occur automatically, as opposed to manually, upon the occurrence of a pre-specified event or condition such as well bore pressure. Such sequential or staggered shut down may also be achieved by hard wiring the switch means of the various engines to a central control panel.

Figure 8:
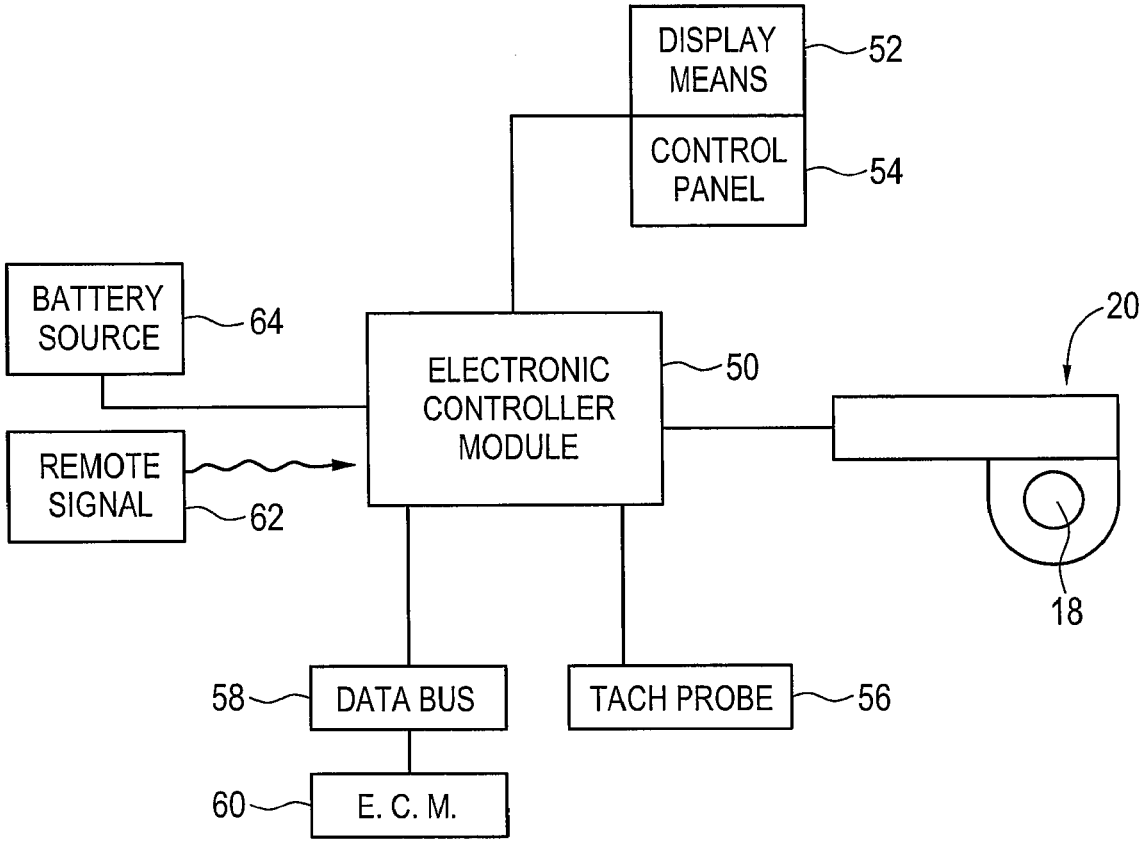
FIG. 8 is a schematic block diagram of the control system of one embodiment of the present invention.

If an electronic controller module (50) is employed as the switch means, the input signals may be manual or automatic as shown in FIG. 8. The signals may be transmitted remotely (62) or manually using a switch or control panel (54). The electronic controller module (50) may be connected to the engine control module (60) using a data bus (58). Data regarding the operating conditions of the engine are transmitted from the engine control module (60) to the electronic controller module (50) and upon a condition reaching a specified state (for example, a specified high temperature, or a specified oil pressure), the electronic controller module (50) activates the electric motor (12) to close the butterfly valve (16). Similarly, a tach probe (56) may be mounted in the engine, for example on the fly-wheel or other spinning mass, with data from the tach probe (56) being fed to the electronic controller module (50). The electronic controller module (50) is connected to a non-ignition battery source (64) and is capable of handling varying voltages, including without limitation, charges of between 12 and 32 volts. The electronic controller module (50) provides power to the electric motor (12). In one embodiment, a charge of about 12 volts is supplied to the motor. In another embodiment there are two power wires from the electronic controller module (50) to the electric motor, one for a positive current, and one for a negative current to reverse the polarity of the electric motor (12) to open and close the butterfly valve (16). The electronic controller module (50) may also be connected by two wires to a valve sensor (not show in the figures) that can sense when the butterfly valve (16) is open and closed. The electronic controller module (50) may be connected to display means (52), such as an LCD or plasma screen, and can accordingly display indication signals to inform a user whether the butterfly valve (16) is opened or closed. In one embodiment, the display means may simply comprise labeled light diodes. A control panel (54) may also be connected to the electronic controller module (50) allowing a user to alter the parameters of what will trigger the electronic controller module (50) to activate the electric motor (12), and at what speed the electric motor (12) will run. The control panel (54) may be a form of key pad or a touch sensitive screen. One skilled in the art would understand that the display means and control panel may be combined into one unit. The display means (52) may also display information transmitted from the electronic controller module (50) regarding what input signal caused the electronic controller module (50) to initiate shut down. For example, a manually transmitted signal, a remote signal and if so whether it part of a master shut down, or an operating condition. This information is very important to a user in assessing when and how to restart after shut down, and to identify what the problem leading to shut down was. In the context of a vehicle, the display means (52) and control panel (54) may be dashboard mounted.

Figure 6:
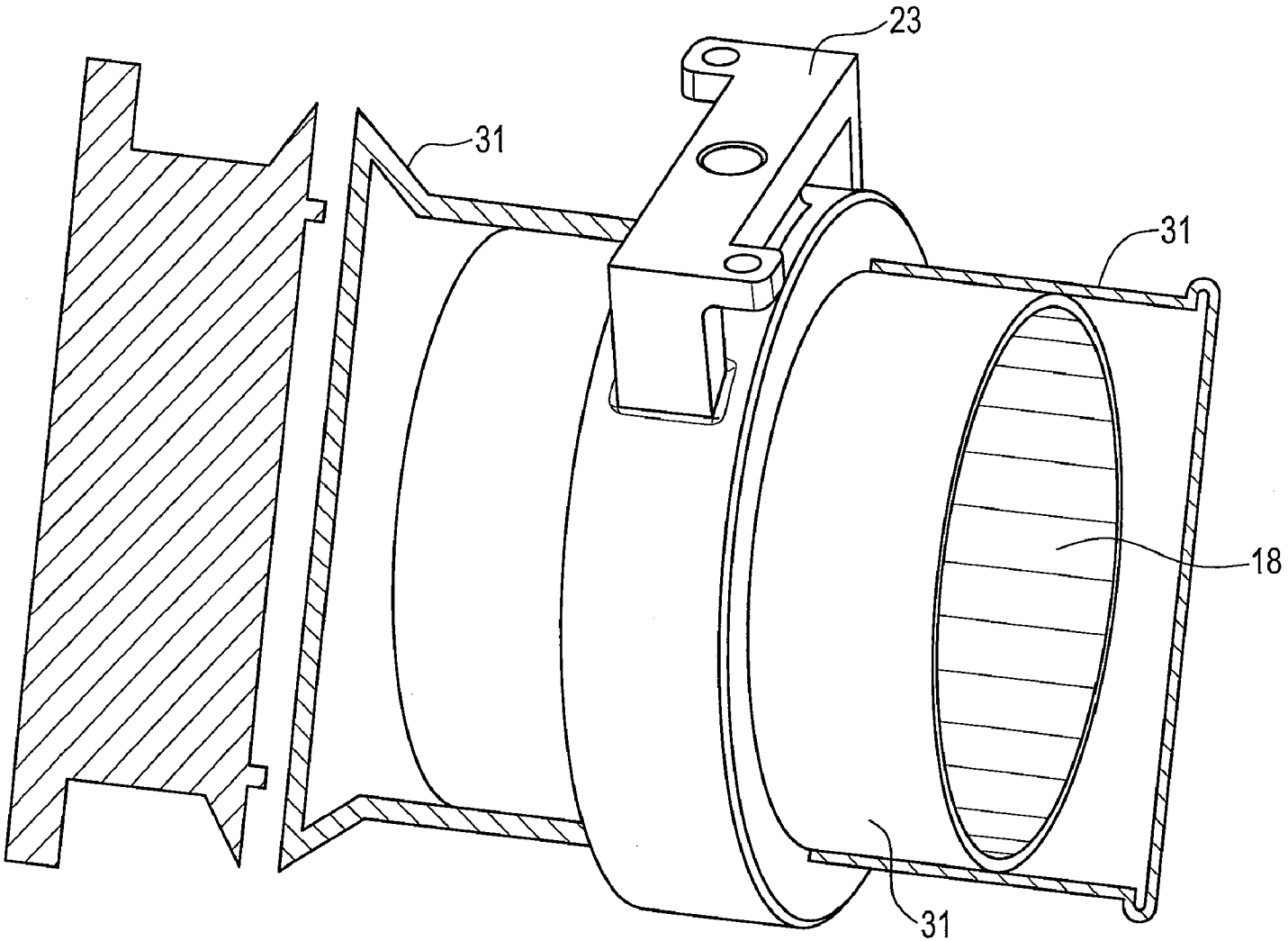
FIG. 6 is a diagrammatic depiction of one embodiment of the present invention.
Figure 7:
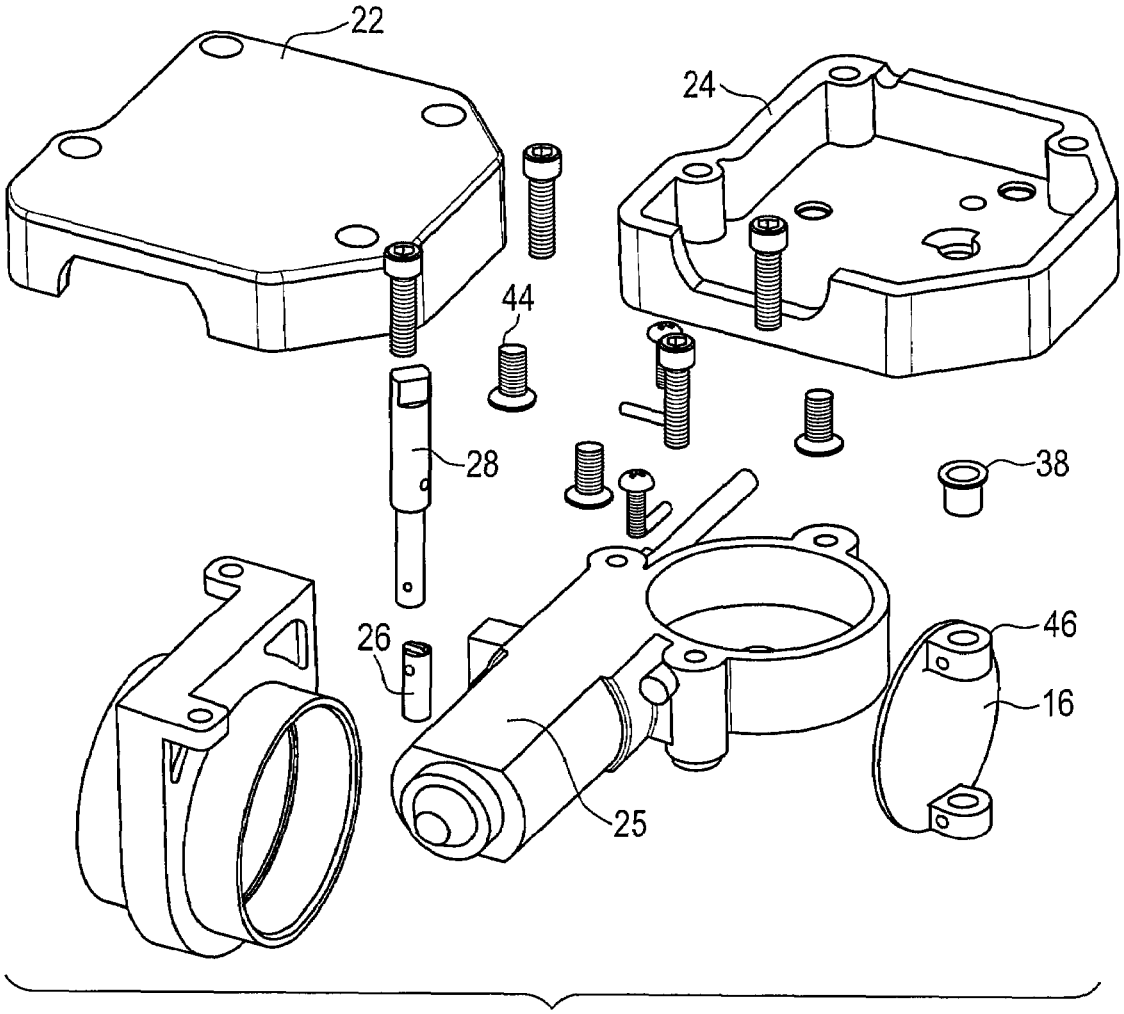
FIG. 7 is an exploded diagrammatic depiction of the components of one embodiment of the present invention.

As shown in FIG. 6, sleeves (31) may be attached to the air-flow passage (18) to enable sealed connection of the tubular air-flow passage (18) to the air intake of the engine. The sleeves may be coupled to the air intake using attachment means employed by those skilled in the art including, without limitation, collars, set screws, clamps and complimentary ring groove configurations. It can be understood that sleeves of varying sizes may be employed to enable use of a standard sized valve unit with air intakes of varying sizes. In one embodiment, there may be a variety of standard valve unit sizes (for example 3 inches, 4 inches and 7 inches). The size closest to the size of air intake would be selected, and any further adjustment required would be achieved by selecting an appropriately sized sleeve. The sleeves may be constructed from aluminum or steel, or from any other suitable material. The shut-off valve (10) is installed in line with the air intake and will work optimally if positioned on the pressure side of any turbo system.

Although described in the context of run away in a diesel engine, it will be understood that the shut-off valve (10) may be used to stop any type of engine having an air intake.

As will be apparent to those skilled in the art, various modifications, adaptations and variations of the foregoing specific disclosure can be made without departing from the scope of the invention claimed herein.

What is claimed is:

1. An air intake shut-off valve for an engine having an air intake, the shut-off valve comprising;

(a) a housing having an air-flow passage extending through the housing;

(b) a flow control valve disposed in the air-flow passage, the flow control valve being movable between a first open position that permits air-flow through the passage and a second closed position that prevents air-flow through the passage;

(c) actuation means for moving the flow control valve between its first open position and its second closed position, and for moving the flow control valve between its second closed position and its first open position;

(d) switch means for activating and deactivating the actuation means; and (e) means for sealably connecting the air-flow passage to the air intake of the engine;

wherein the actuation means is adapted to move the flow control valve between its first open position and its second closed position in a period of time that is greater than 1 second, but that is less than 6 seconds.

2. The shut-off valve of claim 1 wherein the flow control butterfly valve.

3. The shut-off valve of claim 1 wherein the actuation means comprises an actuator having a drive means for controlling the movement of the flow control valve between the first open position and the second closed position and between the second closed position and the first open position.

4. The shut-off valve of claim 3 wherein the actuator comprises;

(a) a pinion gear connected to the flow control valve;

(b) a worm gear driving the pinion gear; and (c) an electric motor driving the worm gear.

5. The shut-off valve of claim 1, wherein the actuation means is adapted to move flow control valve between its first open position and its second closed position in a period of time of about 2 seconds to about 3 seconds.

6. The shut-off valve of claim 1, wherein the actuation means is adapted to move the flow control valve between its first open position and its second closed position in a period of time of about 4 seconds to about 5 seconds.

7. The shut off valve of claim 1 wherein the switch means is responsive to an operating condition of the engine.

8. The shut-off valve of claim 7 wherein the engine operating condition includes any one of temperature, pressure or RPM.

9. The shut-off valve of claim 1 wherein the switch means is responsive to an operating condition of an ancillary component of the engine.

10. The shut-off valve of claim 1 wherein the switch means is responsive to a manually transmitted signal.

11. The shut-off valve of claim 1 wherein the switch means is responsive to a remotely transmitted signal.

12. The shut-off valve of claim 1 wherein the switch means comprises an electronic controller module.

13. The shut-off valve of claim 12 wherein the electronic controller module controls the speed of the electric motor.

14. The shut-off valve of claim 12 wherein the electronic controller module may be pre-programmed to activate the actuation means upon the occurrence of a specific operating condition of the engine.

15. The shut-off valve of claim 14 wherein the specific engine operating condition includes any one of a specific temperature level, a specific pressure level or a specific RPM level.

16. The shut-off valve of claim 12 wherein the electronic controller module may be pre-programmed to activate the actuation means upon the occurrence of a specific operating condition of an ancillary component of the engine.

17. The shut off valve of claim 12 further comprising a valve sensor to sense whether the flow control valve is open or shut, and wherein the electronic controller module is operatingly connected to the valve sensor.

18. The shut-off valve of claim 17 wherein the valve sensor comprises a micro-switch engaging the flow control valve mechanism, the micro-switch being electronically connected to the electronic controller module.

19. The shut-off valve of claim 17 further comprising display means connected to the electronic controller module, the display having indicators for indicating whether the flow control valve is open or shut.

20. The shut-off valve of claim 12 further comprising display means connected to the electronic controller module, the display having indicators.

21. The shut-off valve of claim 1 wherein the housing comprises a drive housing that is releasably attached to a tubular channel housing, the channel housing defining the air-flow passage.

22. The shut-off valve of claim 21 wherein the drive housing comprises a motor and gear housing sandwiched between a top cover and a base cover.

23. The shut-off valve of claim 1 wherein the means for sealably connecting the air-flow passage to the air intake of the engine comprises at least one sleeve extending outwards from the air-flow passage.

24. The shut off valve of claim 23, wherein a standard size of shut-off valve is adaptable for use in varying sizes of air intakes by using differing sizes of sleeves.

25. An air intake shut-off valve for an engine having an air intake, the shut-off valve comprising;

(d) a housing having an air-flow passage extending through the housing;

(e) a butterfly valve disposed in the air-flow passage, the butterfly valve being movable between a first open position that permits air-flow through the passage and a second closed position that prevents air-flow through the passage, the butterfly valve having a central shaft;

(f) a pinion gear connected to the shaft of the butterfly valve;

(g) a worm gear driving the pinion gear;

(h) an electric motor connected to the worm gear;

(i) a controller module for activating and deactivating the electric motor and for controlling the speed of the motor; and (j) means for sealably connecting the air-flow passage to the air intake of the engine;

wherein the actuation means is adapted to move the flow control valve between its first open position and its second closed position in a period of time that is greater than 1 second, but that is less than 6 seconds, whereby rotation of the worm gear causes rotation of the shaft of the butterfly valve such that the butterfly valve can be moved between its first open position and its second closed position and between its second closed position and its first open position in a pre-determined period of time.

26. The shut-off valve of claim 25 wherein the period of time is between about 2 seconds and about 3 seconds.

27. The shut-off valve of claim 25 wherein the period of time is between about 4 seconds and about 5 seconds.

* * * * *